US006743084B1

(12) United States Patent
Cheng

(10) Patent No.: US 6,743,084 B1
(45) Date of Patent: Jun. 1, 2004

(54) EMERY POLISHING MACHINE

(75) Inventor: Mao Nan Cheng, Taichung (TW)

(73) Assignee: San Ford Machinery Co., Ltd., Taichung (TW)

( * ) Notice: Subject to any disclaimer, the term of this patent is extended or adjusted under 35 U.S.C. 154(b) by 0 days.

(21) Appl. No.: 10/422,693

(22) Filed: Apr. 25, 2003

(51) Int. Cl.[7] ..... B24B 21/00
(52) U.S. Cl. ..... 451/299; 451/178; 451/311
(58) Field of Search ..... 451/178, 167, 451/184, 65, 311, 168, 109, 110, 120, 57, 296, 299, 300; 144/1.1, 3.1

(56) References Cited

U.S. PATENT DOCUMENTS 5,056,272 A * 10/1991 Battaglia ..... 421/41
6,001,004 A * 12/1999 Botteghi ..... 451/168
6,299,512 B1 * 10/2001 Costa et al. ..... 451/59
6,299,517 B1 * 10/2001 Weber ..... 451/309
6,342,000 B1 * 1/2002 Yan ..... 451/304
6,602,118 B1 * 8/2003 Johnson ..... 451/65

* cited by examiner

*Primary Examiner*—Dung Van Nguyen
(74) *Attorney, Agent, or Firm*—Troxell Law Office PLLC

(57) ABSTRACT

An emery polishing machine is provided with plural adjusting devices positioned between the opposite shaft ends of two emery polishing wheels and machine box. The adjusting devices enable the two emery-polishing wheels to be micro-adjusted to move upward and downward independently. Emery paper tapes of different-sized sands can be fitted on the two emery-polishing wheels to carry out rough and fine polishing at the same time. Two dust-collecting pipes are provided at one side of the dust-preventing cover of the machine box, and plural rollers are provided on the dust-preventing cover. Thus, after a wooden board has one side polished, it can be turned over and directly placed on the rollers on the dust-preventing cover to be moved in a feeding opening to have the other side polished. Thus a wooden board is quickly moved with less force and less space.

2 Claims, 7 Drawing Sheets

EMERY POLISHING MACHINE

BACKGROUND OF THE INVENTION

1. Field of the Invention

This invention relates to an emery-polishing machine, particularly to one applicable to carpentry.

2. Description of the Prior Art

A conventional emery-polishing machine 10 for carpentry, as shown in FIG. 1, includes a machine box 11 provided with a conveyer 12 for carrying a work to be polished. An emery-polishing unit 13 consisting of two emery-polishing wheels 131 is provided above the conveyer 12 and driven by a motor (not shown) to actuate the two emery polishing wheels 131 to rotate. Each emery-polishing wheel 131 is fitted with an emery paper tape 131A on the circumferential surface for polishing the surface of a wooden board. Besides, the machine box 11 is provided with plural dust-collecting pipes 111 positioned above the two emery-polishing wheels 131 and connected with a dust-collecting device for preventing dust from floating about. The conventional emery-polishing machine 10 has a function of polishing the surfaces of a wooden board, but it has some defects described below.

1. The two emery polishing wheels 131 are fixedly positioned, impossible to be adjusted in height, therefore only emery paper tape 131A of same-sized sands can be attached on the emery polishing wheels 131 for use. If emery paper tape 131A of different-sized sands are simultaneously attached on the two emery-polishing wheels 131 for use, the comparatively thin emery paper tape 131A of fine sands will fail to contact the surface of a wooden board to carry out polishing. Under the circumstances, to polish the surface of a wooden board, the emery polishing wheels 131 of the emery-polishing machine 10 have to be first attached thereon with coarse-sand paper tapes 131A for carrying out rough polishing. Subsequently, the coarse-sand paper tapes 131A are replaced with fine-sand paper tapes 131A and the conveyer 12 is adjusted in height for carrying out fine polishing, thus wasting mach time in replacing the emery paper tapes 131A repeatedly, lowering working efficiency and increasing cost.

2. The emery polishing machine 10 can only carry out polishing on one side of a wooden board at a time. To have the opposite side polished, the wooden board has to be turned over and moved to the feeding opening 14 a new for carrying out polishing, and when moved to the feeding opening 14, the wooden board has to by-pass one side of the emery polishing machine 10 because plural dust-collecting pipes 111 are positioned on top of the emery polishing machine 10, thus taking much labor and space.

SUMMARY OF THE INVENTION

A main objective of the invention is to offer an emery-polishing machine able to have its emery polishing wheels micro-adjusted to move upward and downward independently. Thus, the two emery-polishing wheels can be fitted thereon with emery paper tapes of different-sized sands according to practical needs to carry out rough and fine polishing on a wooden board at one round of conveying, able to heighten working efficiency.

Another objective of the invention is to offer an emery polishing machine having two dust-collecting pipes provided at one side of its dust-collecting cover above two emery polishing wheels, and having plural units of rollers provided on the dust-collecting cover. Thus, after polished on one side, a wooden board can be turned over and directly placed on the rollers to be slidably moved to a feeding open in g for carrying out polishing on the opposite side, able to transport a wooden board quickly with less force.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
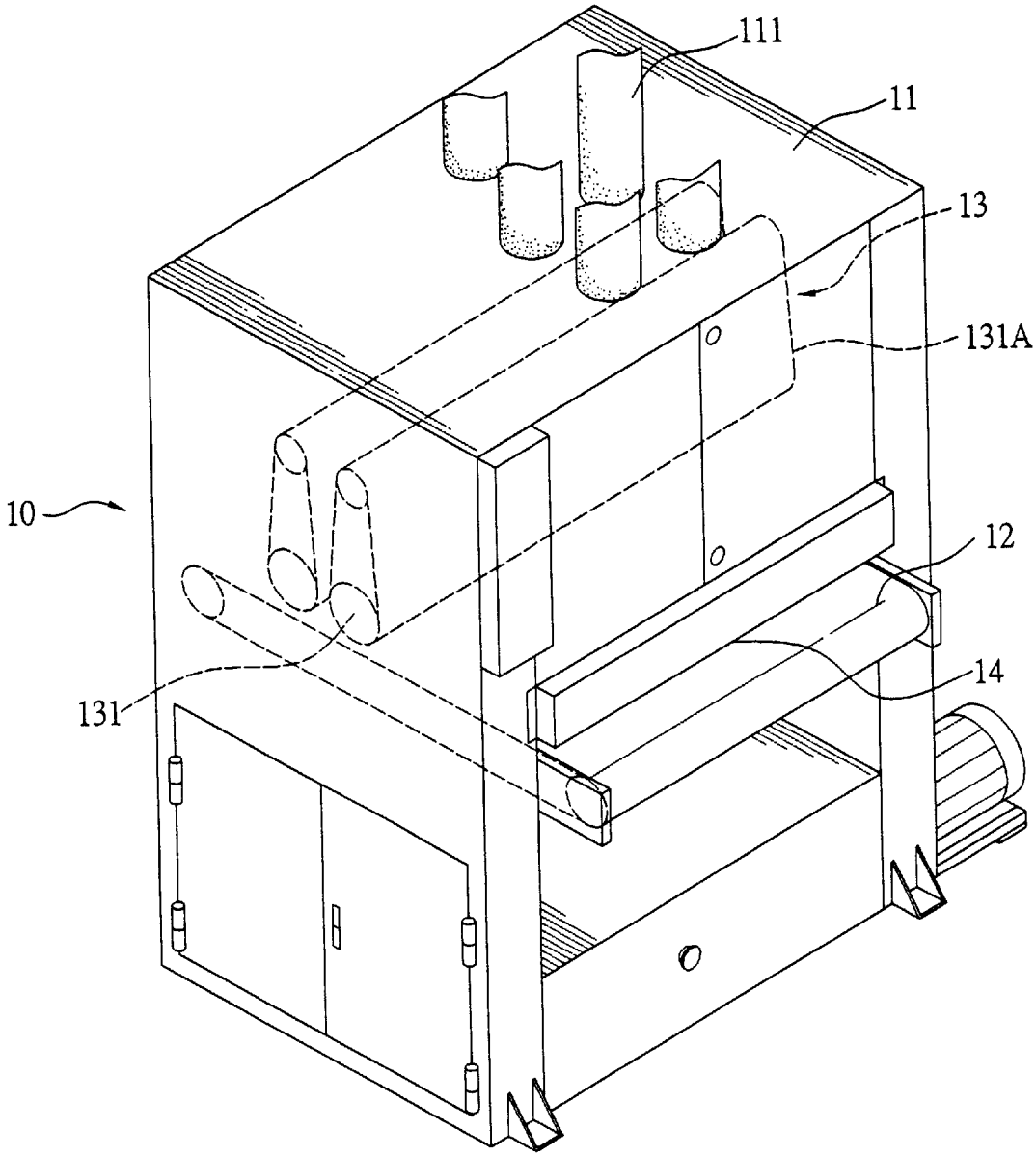
FIG. 1 PRIOR ART
FIG. 1 is a perspective view of a conventional emery-polishing machine.
Figure 2:
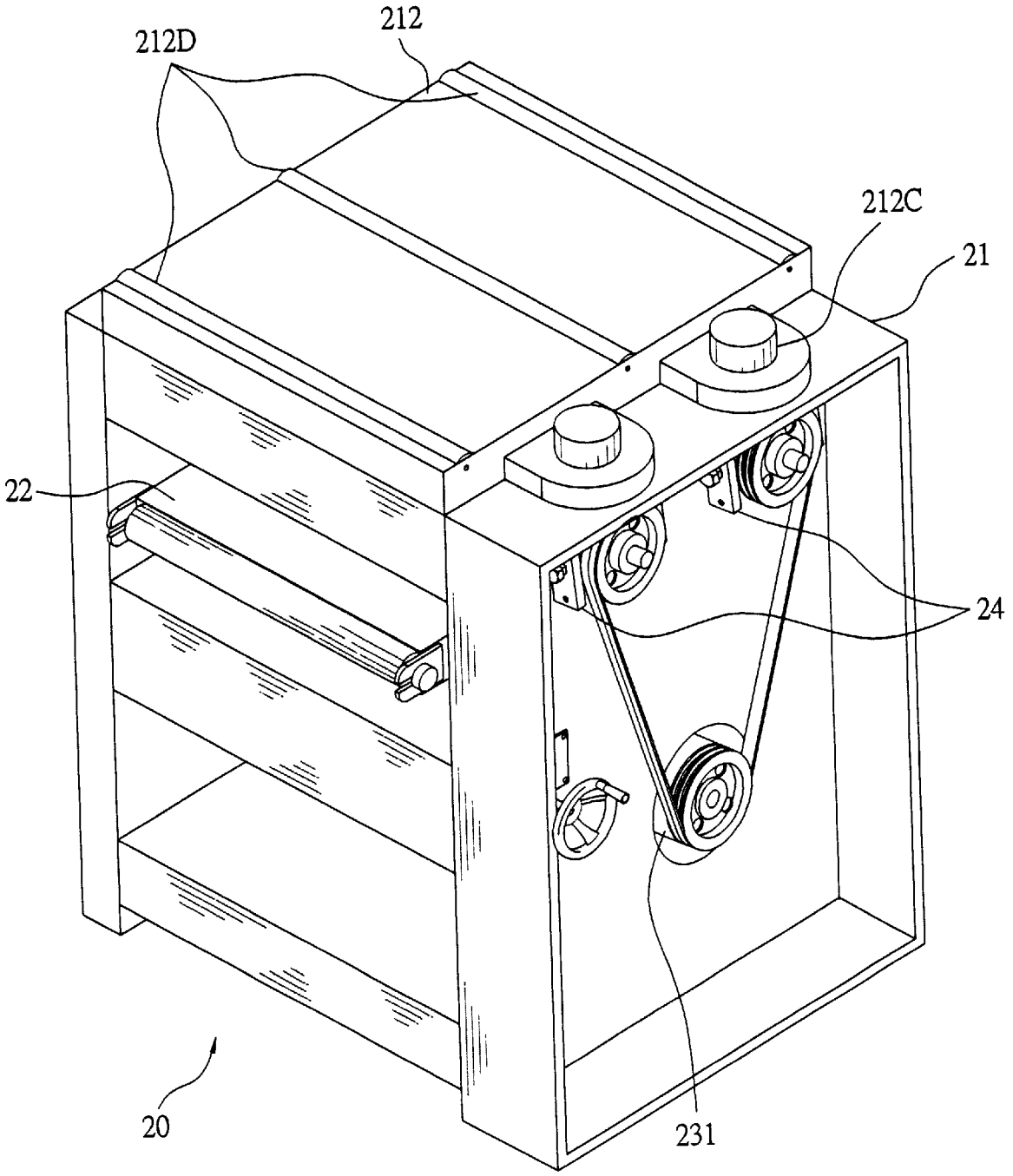
FIG. 2 is a perspective view of an emery-polishing machine in the present invention.
Figure 3:
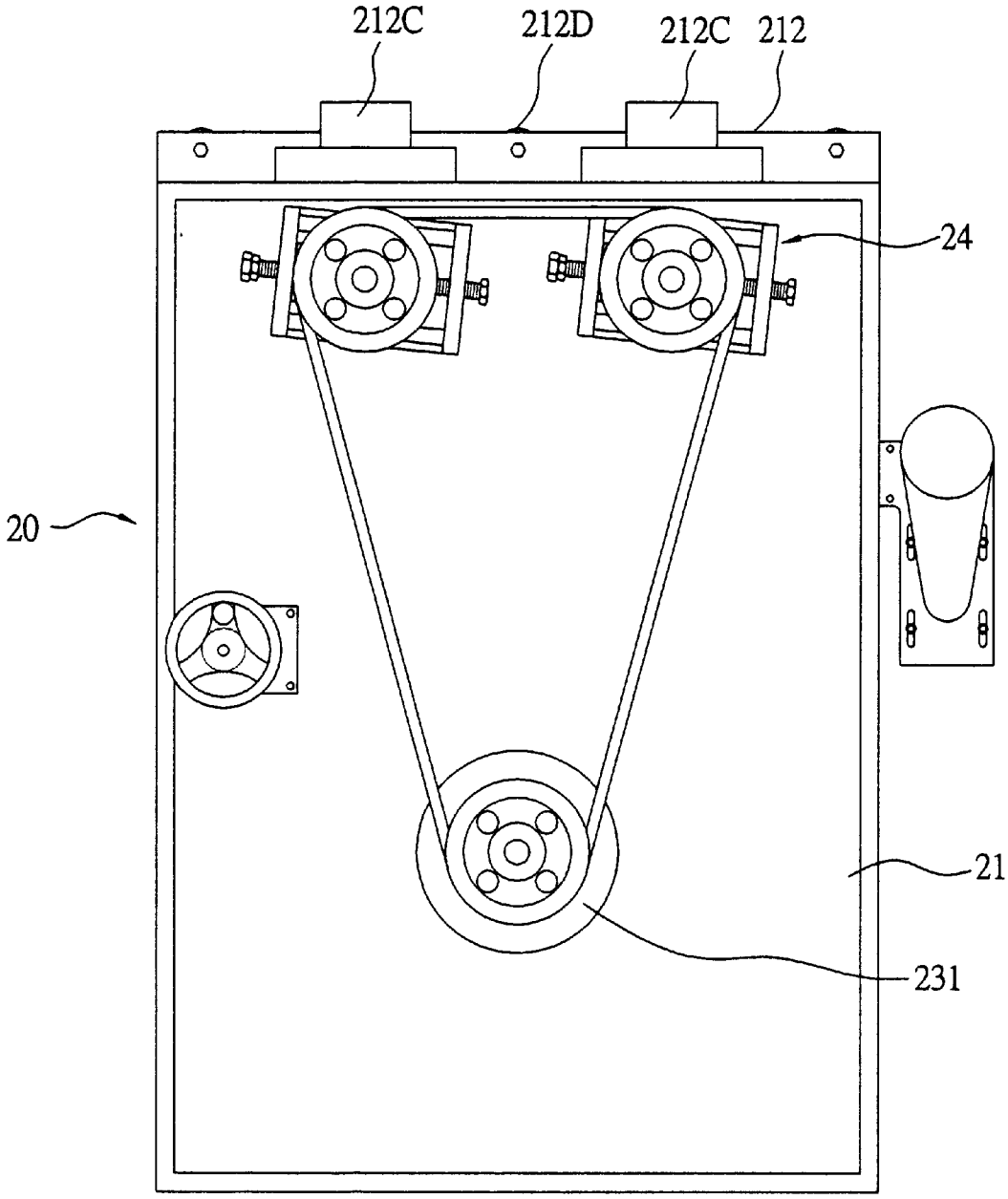
FIG. 3 is a side view of the emery-polishing machine in the present invention.

A preferred embodiment of an emery polishing machine in the present invention, as shown in FIGS. 2 and 3, includes a machine box 21, a conveyer 22, an emery polishing unit 23 and plural adjusting devices 24 as main components combined together.

The conveyer 22 is provided in the machine box 21, and the emery-polishing unit 23 is located above the conveyer 22. The polishing unit 23 is composed of a motor 231 and two emery polishing wheels 232. Thus, a wooden board can be carried by the conveyer 22 to be positioned beneath the two emery-polishing wheels 232 to be polished. The machine box 21 is provided on one end of the topside with two dust-collecting pipes 212C connected with a dust-collecting device for collecting dust and preventing dust from floating about.

Figure 4A:
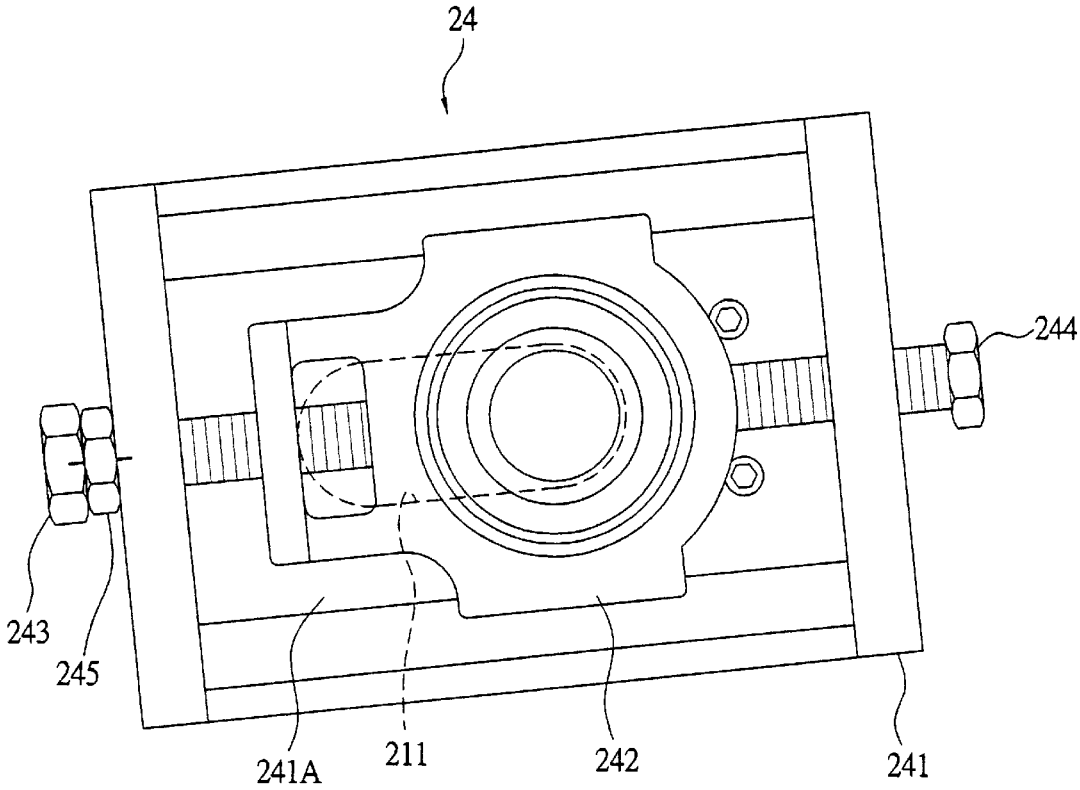
FIGS. 4A and 4B are side cross-sectional views of the adjusting device of the emery polishing machine in the present invention, indicating a micro-adjusting condition.
Figure 4B:
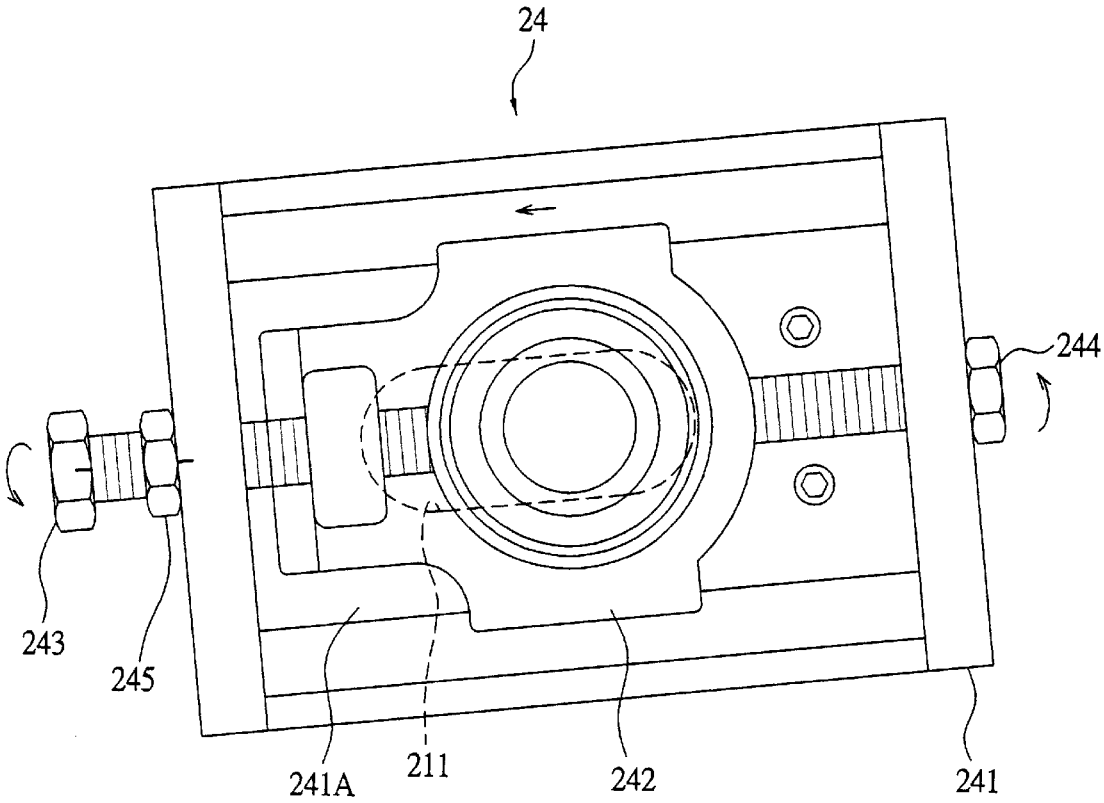

The adjusting devices 24 are respectively provided between the opposite shaft ends of the two emery polishing wheels 232 and the inner wall of the machine box 21. Each adjusting device 24, as shown in FIG. 4, consists of a fixing base 241, a bearing base 242, an adjusting bolt 243 and a resisting bolt 244. The fixing base 241 is positioned in a slightly slanting condition and secured on the opposite inner walls of the machine box 21, having a slide groove 241A for the bearing base 242 to slide therein. Each emery-polishing wheel 232 has its opposite shaft ends received in the bearing base 242, which can slide a little slantingly in the slide groove 241A. The adjusting bolt 243 is orderly screwed through the fixing base 241, the left wall of the slide groove 241A and the left wall of the bearing base 242 for adjusting and positioning the bearing base 242. The resisting bolt 244 is screwed through the fixing base 241 and the right wall of tie slide groove 241A for firmly pushing against the bearing base 242.

Further the opposite inner walls of the machine box 21, which respectively face the opposite shaft ends of each emery polishing wheel 232, are respectively carved with a long accommodating groove 211 for facilitating the opposite shaft ends of the emery polishing wheels 232 to be inserted and moved therein.

Figure 5:
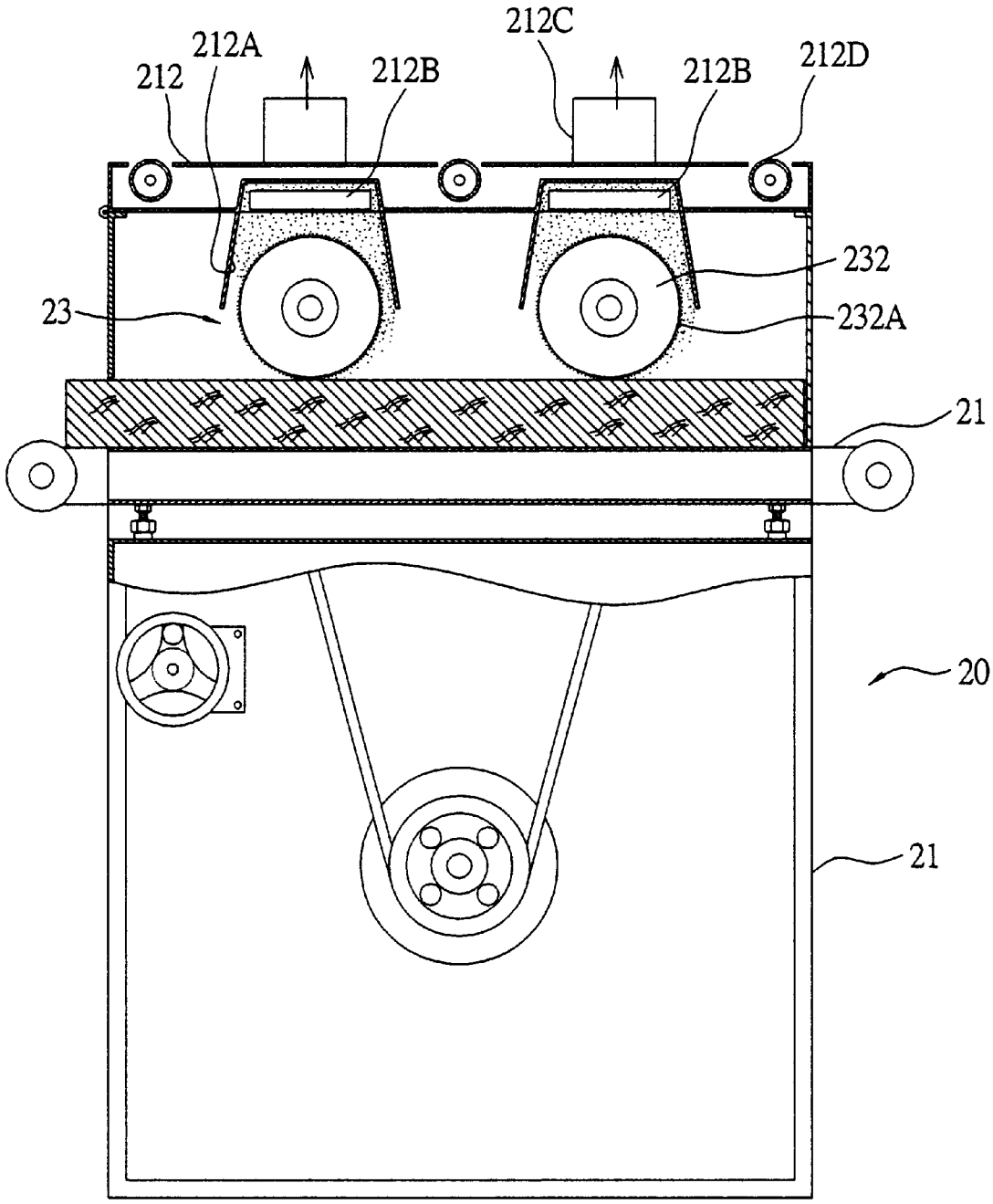
FIG. 5 is a partial side cross-sectional view of the emery-polishing machine in the present invention.
Figure 6:
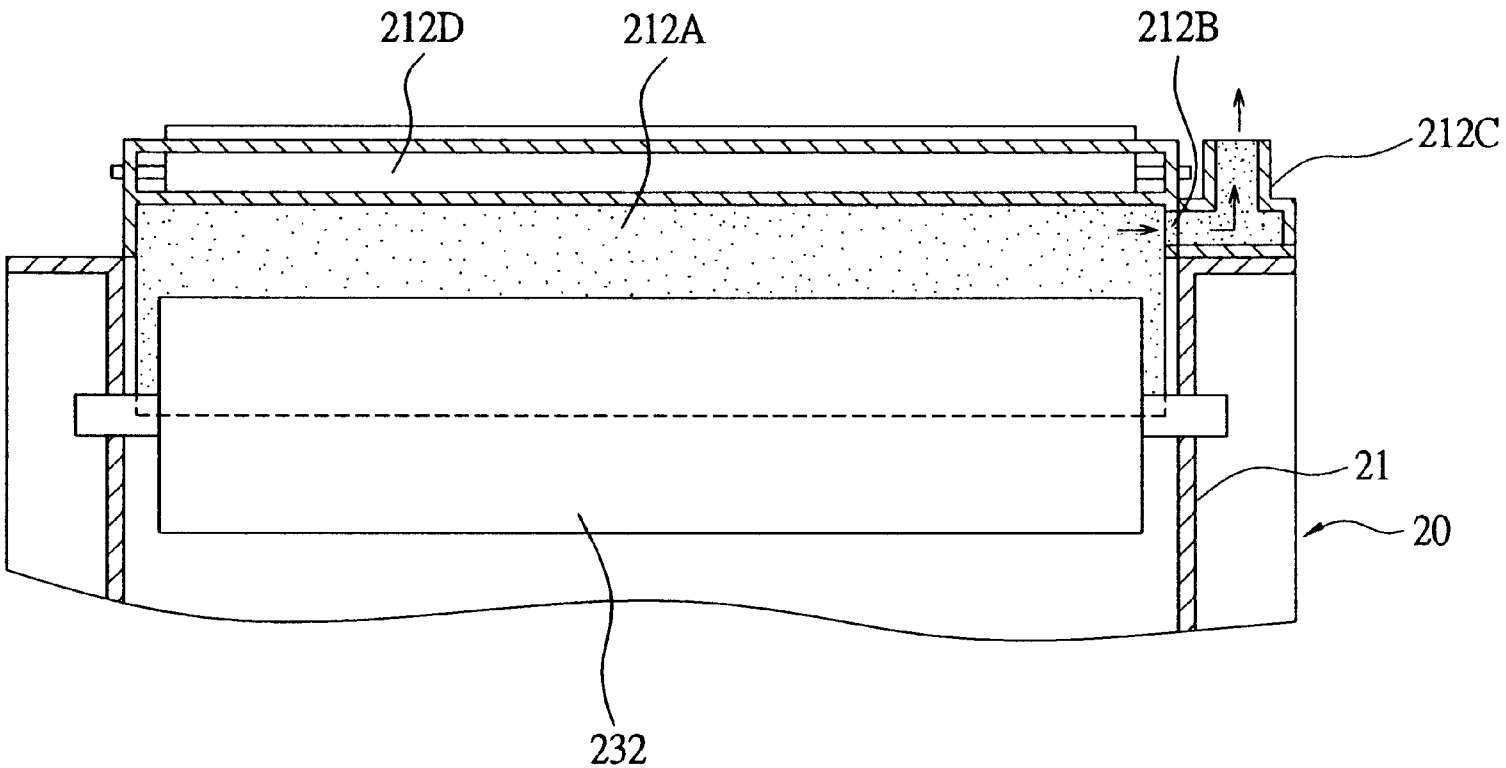
FIG. 6 is partial front cross-sectional view of the emery-polishing machine in the present invention.

In addition, a dust-preventing cover 212 able to be turned open is pivotally provided on the topside of the machine box 21, having two dust-receiving grooves 212A formed under the inner wall facing the upper outer circumferences of the two emery polishing wheels 232, as shown in FIGS. 5 and 6. Each dust-receiving groove 212A formed at one side with a sucking opening 212B communicating with the dust-collecting pipe 212C. The dust-preventing cover 212 is further pivotally provided with plural units of not-powered rollers 212D.

Furthermore, a tightening nut 245 is provided between the adjusting bolt 243 and the fixing base 241 for stabilizing the adjusting bolt 243 to prevent it from becoming loose and affecting the bearing base 242 after the adjusting bolt 243 is adjusted and positioned.

As can be noted from the above description, this invention has some advantages described below.

1. The adjusting devices 24 respectively positioned between the opposite shaft ends of the emery polishing wheel 232 and the machine box 21 are able to micro-adjust the bearing base 242 to move upward and downward, as shown in FIG. 4. During micro adjusting, the order of turning around the adjusting bolt 243 and the resisting bolt 244 is decided by the location and the moving condition of the bearing base 244. When the adjusting bolt 243 actuates the bearing base 242 to move and be positioned, the tightening nut 245 and the resisting bolt 244 are turned tightly so as to prevent the bearing base 242 from becoming loose and sliding off.

2. The bearing base 242 of the adjusting device 24 is positioned in a slightly slanting condition, therefore the two emery polishing wheels 232 can be adjusted to move upward and downward accurately, having excellent effect of micro-adjusting. Besides, since the two emery-polishing upward and downward, their emery paper tapes 232A of different-sized sands can simultaneously carry on rough and fine polishing at the same time.

3. The two dust-collecting pipes 212C are provided at one side of the dust-preventing cover 212, and plural units of rollers 212D are positioned on the topside of the dust-preventing cover 212, as shown in FIG. 5. Thus, after a wooden board has one side polished, it can be turned over and directly placed on the rollers 212D to be slidably moved forward and then pushed in the feeding opening for polishing oil the other side, able to transport a wooden board quickly with less labor, needless to take much space and increasing processing efficiency.

4. The two dust-receiving grooves 212A respectively formed above the two emery polishing wheels 232 are able to control the dust produced by polishing a wooden board in the interior space of the dust-receiving grooves 212A, and then the dust is sucked in the dust-collecting pipes 212C through the sucking opening 212B and finally gathered in the dust-collecting device, having perfect effect of dust collecting. Besides, the two dust-collecting pipes 212C positioned at one side of dust-preventing cover 212 will never obstruct the wooden board to be transported after it is turned over.

While the preferred embodiment of the invention has been described above, it will be recognized and understood that various modifications may be made therein and the appended claims are intended to cover all such modifications that may fall within the spirit and scope of the invention.

I claim:

1. An emery polishing machine comprising a machine box, a conveyer and an emery polishing unit, said emery polishing unit composed of a motor and two emery polishing wheels, said conveyer carrying a wooden board into a feeding opening and positioning it beneath said two emery polishing wheels to be polished, said machine box provided at the topside with two dust-collecting pipes connected with a dust-collecting device, said dust-collecting pipes and said dust-collecting device preventing the dust produced by polishing a wooden board from adjusting about: and, characterized by plural adjusting devices respectively provided between the opposite shaft ends of each said emery polishing wheel and said machine box, each said adjusting device consisting of a fixing base, a bearing base, an adjusting bolt and a resisting bolt, said fixing base positioned in a slightly slanting condition and secured on the opposite inner walls of said machine box, said fixing base formed with a slide groove for said bearing base to slide therein, said bearing bases receiving and fixing the opposite shaft ends of said emery polishing wheels, said two emery polishing wheels able to be micro-adjusted to move a little slantingly together with said bearing base, said adjusting bolt screwed orderly through the left wall of said slide groove of said fixing base and the left wall of said bearing base, said adjusting bolt able to adjust and position said bearing base, said resisting bolt screwed through the right wall of said slide groove of said fixing base, said resisting bolt tightly pushing against said bearing base:

said machine box carved with a long accommodating groove at the opposite inner walls respectively facing the opposite shaft ends of said two emery polishing wheels, said two long accommodating grooves facilitating the opposite shaft ends of said emery polishing wheel to be inserted and moved therein:

said machine box pivotally provided with a dust-preventing cover on top, said dust-preventing cover formed with two dust-receiving grooves under the inner wall, said two dust-receiving grooves respectively facing the upper outer circumferences of said two emery polishing wheels, each said dust-receiving groove formed with a sucking opening at one side, said sucking opening communicating with said dust-collecting pipe, said dust-preventing cover further pivotally provided with plural units of not-powered rollers on top.

2. The emery polishing machine as claimed in claim 1, wherein a tightening nut is provided between said adjusting bolt and said fixing base for stabilizing said adjusting bolt and preventing it from becoming loose after it is turned and positioned.

* * * * *